US011437725B2

(12) United States Patent
Choi et al.

(10) Patent No.: US 11,437,725 B2
(45) Date of Patent: Sep. 6, 2022

(54) FLAT PANEL ANTENNA INCLUDING LIQUID CRYSTAL

(71) Applicant: LG Display Co., Ltd., Seoul (KR)

(72) Inventors: Min-Geun Choi, Paju-si (KR); Seung-Ryull Park, Paju-si (KR); Soo-In Jo, Paju-si (KR); Lae-Bong Jang, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 34 days.

(21) Appl. No.: 16/938,011

(22) Filed: Jul. 24, 2020

(65) Prior Publication Data

US 2021/0028545 A1 Jan. 28, 2021

(30) Foreign Application Priority Data

Jul. 25, 2019 (KR) ..... 10-2019-0090098

(51) Int. Cl.
*H01Q 1/38* (2006.01)
*H01Q 9/04* (2006.01)

(52) U.S. Cl.
CPC ..... *H01Q 9/045* (2013.01); *H01Q 9/0414* (2013.01)

(58) Field of Classification Search
CPC .... H01Q 9/0414; H01Q 1/521; H01Q 9/0485; H01Q 9/045; H01Q 9/0442; H01Q 1/50; H01Q 1/52; H01Q 1/38; H01Q 1/46
See application file for complete search history.

(56) References Cited

U.S. PATENT DOCUMENTS

2010/0073238 A1* 3/2010 Jun ..... H01Q 9/0407 343/700 MS
2011/0050534 A1* 3/2011 Shimayama ..... H01Q 1/3233 343/850
2017/0170572 A1 6/2017 Severson et al.
2020/0243969 A1* 7/2020 Fang ..... H01P 1/184
2020/0381824 A1* 12/2020 Kao ..... H01Q 1/22

FOREIGN PATENT DOCUMENTS

| | | | | |
|---|---|---|---|---|
| CN | 108493592 | A | 9/2018 | |
| JP | 2014-531843 | A | 11/2014 | |
| KR | 10-0214579 | B1 | 8/1999 | |
| KR | 20110109494 | A * | 10/2011 | ..... H01Q 1/248 |
| KR | 10-2014-0090165 | A | 4/2013 | |
| TW | 201813193 | A | 4/2018 | |
| TW | 201925877 | A | 7/2019 | |
| WO | 2013045267 | A1 | 4/2013 | |
| WO | 2018/180035 | A1 | 10/2018 | |

OTHER PUBLICATIONS

Japanese Office Action dated Jul. 27, 2021 issued in corresponding Patent Application No. 2020-122837 (4 pages).
Office Action dated Mar. 16, 2021 issued in Taiwanese Patent Application No. 109124316 (6 pages).

* cited by examiner

*Primary Examiner* — Dieu Hien T Duong
(74) *Attorney, Agent, or Firm* — Polsinelli PC

(57) ABSTRACT

A flat panel antenna includes a first substrate on which a radiation patch and a ground plane are provided; a second substrate; a liquid crystal layer between the first substrate and the second substrate; and a feed portion adjacent to the second substrate, wherein the ground plane includes a slot, wherein the feed portion includes a first spacing part, a second spacing part and a feed line between the first spacing part and the second spacing part, and wherein a thickness of the first substrate is greater than a thickness of the second substrate.

22 Claims, 6 Drawing Sheets

<Resonance Frequency, Gain and Bandwidth of Patch Antenna according to Thickness of First Substrate>

| Thickness of First Substrate (H1, mm) | Patch Antenna | | |
|---|---|---|---|
| | Resonance Frequency (f, GHz) | Gain (G, dBi) | Bandwidth (BW, GHz) |
| 0.2 | 11.62 | 1.98 | 0.64 |
| 0.3 | 11.42 | 2.84 | 0.7 |
| 0.4 | 11.22 | 3.22 | 0.74 |
| 0.5 | 11.04 | 3.35 | 0.78 |
| 0.6 | 10.86 | 3.27 | 0.78 |
| 0.7 | 10.68 | 3.03 | 0.76 |

<Coupling Loss of Patch Antenna according to Thickness and Resonance Frequency of Second Substrate>

| Thickness of Second Substrate (H2, mm) | Coupling Loss of Patch Antenna (L, dB) | | | |
|---|---|---|---|---|
| | 11 GHz | 11.5 GHz | 12 GHz | Average |
| 0.1 | -2.3 | -1.48 | -1.54 | -1.77 |
| 0.2 | -1.63 | -0.99 | -1.34 | -1.32 |
| 0.3 | -1.46 | -1.04 | -4.27 | -2.26 |
| 0.4 | -1.46 | -1.34 | -9.38 | -4.06 |
| 0.5 | -1.57 | -1.81 | -13.31 | -5.56 |

<Coupling Loss of Patch Antenna according to Thickness of Second Substrate>

| λ = 27300 μm | | λ = 26100 μm | | λ = 25000 μm | |
|---|---|---|---|---|---|
| Thickness of 2nd Substrate (H2, μm) | Coupling Antenna (L, dB) | Thickness of 2nd Substrate (H2, μm) | Coupling Antenna (L, dB) | Thickness of 2nd Substrate (H2, μm) | Coupling Antenna (L, dB) |
| 0.018 λ ~ 0.026 λ | -1.5705 | 0.019 λ ~ 0.027 λ | -1.8157 | 0.020 λ ~ 0.028 λ | -13.3117 |
| 0.015 λ ~ 0.018 λ | -1.3428 | 0.015 λ ~ 0.019 λ | -1.4615 | 0.016 λ ~ 0.020 λ | -2.5536 |
| 0.007 λ ~ 0.015 λ | -1.0624 | 0.008 λ ~ 0.015 λ | -0.6959 | 0.008 λ ~ 0.016 λ | -0.6987 |
| ~0.007 λ | -1.6247 | ~0.008 λ | -0.8299 | ~0.008 λ | -0.9106 |

FIG. 5B

<Crosstalk of Patch Antenna according to Width and Resonance Frequency of First and Second Spacing Parts>

| Width of 1st & 2nd Spacing Parts (W2, μm) | Crosstalk (dB) | | |
|---|---|---|---|
| | 11 GHz | 11.5 GHz | 12 GHz |
| W2 > 2 x W1 | -1.0624 | -0.6959 | -0.6987 |
| W2 = 2 x W1 | -1.0684 | -0.6988 | -0.6923 |
| W2 < 2 x W1 | -1.0749 | -0.7019 | -0.7018 |

FIG. 6

FLAT PANEL ANTENNA INCLUDING LIQUID CRYSTAL

CROSS-REFERENCE TO RELATED APPLICATION

This application claims priority from and the benefit of Korean Patent Application No. 10-2019-0090098 filed on Jul. 25, 2019, which is hereby incorporated by reference in its entirety.

BACKGROUND

Field of the Disclosure

The present disclosure relates to a flat panel antenna, and more particularly, to a flat panel antenna including liquid crystal.

Description of the Background

An antenna converts electrical signals into electromagnetic waves or converts electromagnetic waves transmitted in free space such as the atmosphere into electrical signals and serves as a medium for transmitting signals output from a transmission line to the free space.

In general, parameters for measuring the performance of the antenna include directivity D, radiation efficiency $\eta$, antenna gain G, coupling loss L, and a bandwidth BW. The directivity D is obtained by dividing the intensity of radiation in a specific direction by the intensity of radiation in all directions. The radiation efficiency 11 is obtained by dividing the power emitted from the antenna by the power supplied to the antenna. The antenna gain G, which indicates the ability to radiate the power supplied to the antenna from the transmission line in a specific direction, is obtained by multiplying the directivity D and the radiation efficiency $\eta$, that is, $G=D\times\eta$. The coupling loss L is an amount of reduction in energy transmitted between independent lines. The bandwidth BW is a frequency range in which the parameters have proper values and the antenna is efficiently operated.

The antenna having the parameters needs to increase the antenna gain G and reduce the coupling loss L in order to increase the efficiency of power emitted in a specific direction compared to the supplied power.

SUMMARY

Accordingly, the present disclosure is directed to a flat panel antenna that substantially obviates one or more of the problems due to limitations and disadvantages of the prior art.

In addition, the present disclosure is to provide a flat panel antenna that is capable of increasing the antenna gain and the bandwidth and reducing the coupling loss.

Additional features and aspects will be set forth in the description which follows, and in part will be apparent from the description, or may be learned by practice of the inventive concepts provided herein. Other features and aspects of the inventive concepts may be realized and attained by the structure particularly pointed out in the written description, or derivable therefrom, and claims hereof as well as the appended drawings.

To achieve these and other aspect of the present disclosure, as embodied and broadly described herein, a flat panel antenna includes a first substrate on which a radiation patch and a ground plane are provided; a second substrate; a liquid crystal layer between the first substrate and the second substrate; and a feed portion adjacent to the second substrate, wherein the ground plane includes a slot, wherein the feed portion includes a first spacing part, a second spacing part and a feed line between the first spacing part and the second spacing part, and wherein a thickness of the first substrate is greater than a thickness of the second substrate.

It is to be understood that both the foregoing general description and the following detailed description are exemplary and explanatory, and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain various principles of the present disclosure.

In the drawings:

FIG. 5B is a table showing the coupling loss when the thickness of the second substrate is formed to correspond to a multiple of the wavelength of the radiated electromagnetic wave in the flat panel antenna according to the aspect of the present disclosure; and FIG. 6 is a table showing crosstalk corresponding to a distance between a feed line and a part of a feed portion in a flat panel antenna according to the aspect of the present disclosure.

DETAILED DESCRIPTION

Reference will now be made in detail to an example aspect of the disclosure, which is illustrated in the accompanying drawings.

Figure 1A:
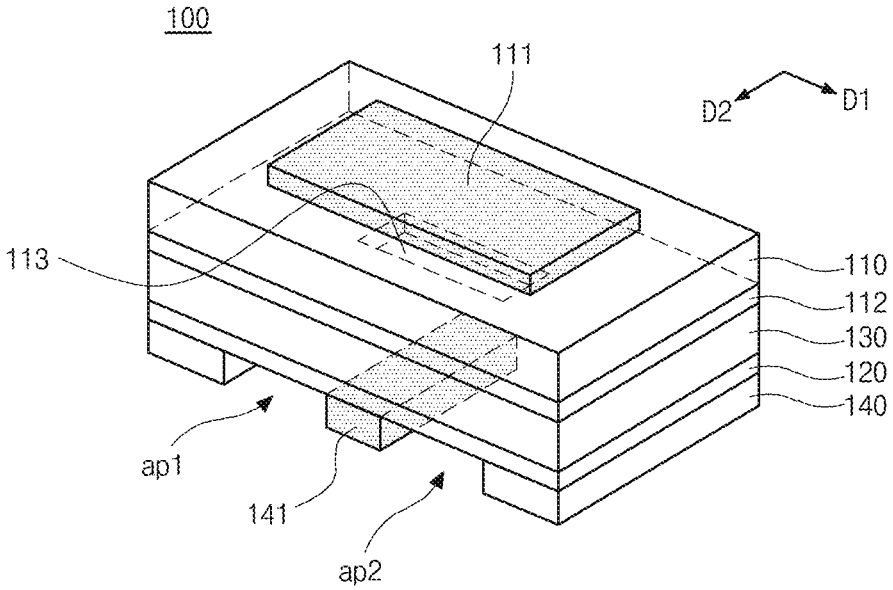
FIG. 1A is a perspective view schematically illustrating a structure of a flat panel antenna according to an aspect of the present disclosure.
Figure 1B:
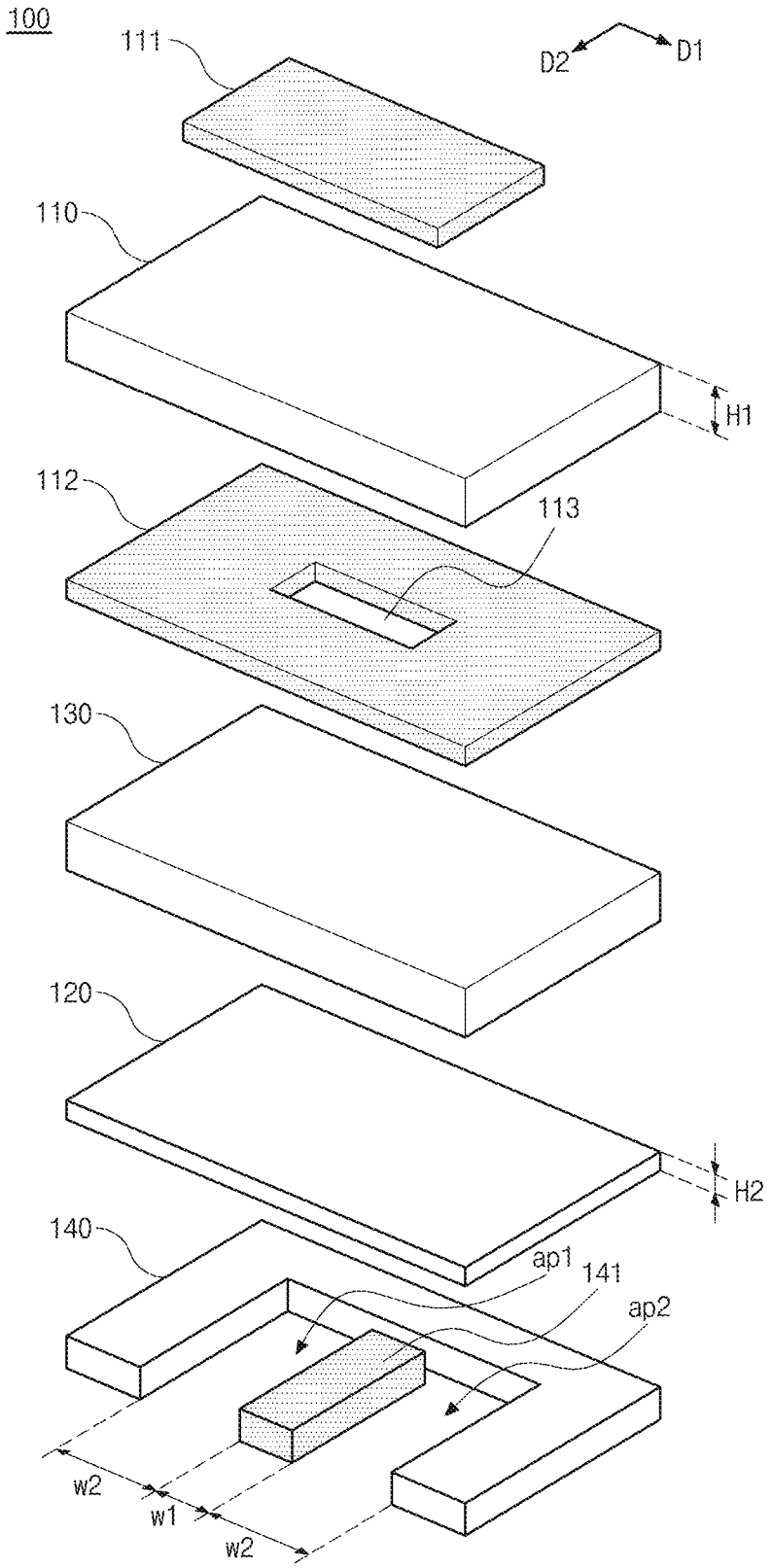
FIG. 1B is an exploded perspective view showing the structure of the flat panel antenna according to the aspect of the present disclosure.

FIG. 1A is a perspective view schematically illustrating a structure of a flat panel antenna according to an aspect of the present disclosure, and FIG. 1B is an exploded perspective view showing the structure of the flat panel antenna according to the aspect of the present disclosure.

In FIG. 1A and FIG. 1B, the flat panel antenna 100 according to the aspect of the present disclosure includes a first substrate 110, a second substrate 120, a liquid crystal layer 130 and a feed portion 140.

The first substrate 110 may have a first thickness H1 and may be a dielectric material that is an insulator having polarity in an electric field.

For example, the first substrate 110 may be a substrate that is formed of glass having first dielectric constant ε1.

A radiation patch 111 and a ground plane 112 may be provided on the first substrate 110. The radiation patch 111 may be provided at a first surface of the first substrate 110, and the ground plane 112 may be provided at a second surface of the first substrate 110. For example, the first surface of the first substrate 110 may be an upper surface of the first substrate 110, and the second surface of the first substrate 110 may be a lower surface of the first substrate 110. Thus, the radiation patch 111 may be disposed over the first substrate 110 and the ground plane 112 may be disposed below the first substrate 110.

A fringe field may be generated between the radiation patch 111 and the ground plane 112. An electromagnetic field generated between an edge of the radiation patch 111 and the ground plane 112 may be exposed over the radiation patch 111 and may be radiated into free space.

The ground plane 112 may include a slot 113 that is an opening, and the slot 113 may have a rectangular shape.

When the slot 113 has a rectangular shape, the slot 113 may be formed in a first direction D1. Namely, a long side of the slot 113 may be formed in the first direction D1, and a short side of the slot 113 may be formed in a second direction D2 perpendicular to the first direction D1.

The slot 113 serves as an impedance transformer and a parallel LC circuit. An electric field formed by the feed portion 140 passes through the slot 113 and is transmitted to the radiation patch 111, so that currents can be induced to flow in the radiation patch 111.

The second substrate 120 may have a second thickness H2 and may be a dielectric material that is an insulator having polarity in an electric field like the first substrate 110.

The second substrate 120 may be a substrate that is formed of glass or formed of polyimide having second dielectric constant ε2.

When the second substrate 120 is a substrate formed of glass, the second dielectric constant ε2 of the second substrate 120 may be the same as the first dielectric constant ε1 of the first substrate 110.

The liquid crystal layer 130 may be disposed between the first substrate 110 and the second substrate 120. The liquid crystal layer 130 may include liquid crystal molecules, and an arrangement of the liquid crystal molecules may be changed according to a voltage applied to the liquid crystal layer 130.

The feed portion 140 may include a feed line 141. The feed portion 140 may further include a first spacing part ap1 and a second spacing part ap2 that are spaces where the feed line 141 is spaced apart from other parts of the power feeding portion 140. The feed portion 140 may be disposed under the second substrate 120. The feed line 141, the first spacing part ap1 and the second spacing part ap2 may be arranged in the second direction D2 perpendicularly crossing the first direction D1. Namely, a long side of the feed line 141 and long sides of the first spacing part ap1 and the second spacing part ap2 may be parallel to the second direction D2.

More particularly, the feed line 141 may have a first width W1 in the first direction D1, and the long side of the feed line 141 may be arranged in the second direction D2. The feed line 141 may be disposed to cross the radiation patch 111 and the slot 113 when the flat panel antenna 100 is viewed from the top.

The feed line 141 generates an electric field according to a voltage supplied from the outside, and the generated electric field passes through the slot 113 and reaches the radiation patch 111, so that currents can be induced to flow in the radiation patch 111. That is, the feed line 141 and the radiation patch 111 may be coupled to thereby transmit the energy applied to the feed line 141 into the radiation patch 111.

The first spacing part ap1 and the second spacing part ap2 each may have a second width W2 in the first direction D1, and the long sides of the first spacing part ap1 and the second spacing part ap2, which are parallel to the feed line 141, may be arranged in the second direction D2. The feed line 141 may be disposed between the first spacing part ap1 and the second spacing part ap2.

The arrangement of the liquid crystal molecules included in the liquid crystal layer 130 can be changed by a voltage applied to the ground plane 112 and the feed line 141, and accordingly, a dielectric constant of the liquid crystal layer 130 may also be changed.

When the dielectric constant of the liquid crystal layer 130 changes, a phase velocity of an electromagnetic wave changes, so that a phase of signals transmitted and received by the flat panel antenna can be changed.

As described above, the ground plane 112, the feed line 141 and the liquid crystal layer 130 may serve as a phase shifter that changes the phase of signals transmitted and received by the antenna.

In addition, the radiation patch 111 and the ground plane 112 are provided on the first substrate 110 and the feed line 141 is disposed adjacent to the second substrate 120, so that the flat panel antenna 100 can serve as a patch antenna.

As shown in FIG. 1A and FIG. 1B, the flat panel antenna 100 according to the aspect of the present disclosure includes one radiation patch 111, one ground plane 112, and one feed line 141 to serve as one patch antenna. However, the present disclosure is not limited thereto, and the flat panel antenna can include two or more radiation patches, two or more ground planes and two or more feed lines. In this case, the radiation patches, the ground planes and the feed lines corresponding to each other constitute a plurality of patch antennas with the first substrate and the second substrate interposed therebetween, and the plurality of patch antennas form an array antenna. Namely, a plurality of radiation patches may be provided at an upper surface of a first substrate, a plurality of ground planes may be provided at a lower surface of the first substrate, and a plurality of feed lines may be provided at a lower surface of a second substrate. The plurality of radiation patches, the plurality of ground planes, and the plurality of feed lines, which correspond to and overlap each other, may constitute a plurality of patch antennas, respectively.

At this time, the feed portion 140 may further include a power dividing part (not shown) formed of a printed circuit board, and the power dividing part may have a structure of a T-junction power divider or a Wilkinson power divider.

Figure 2:
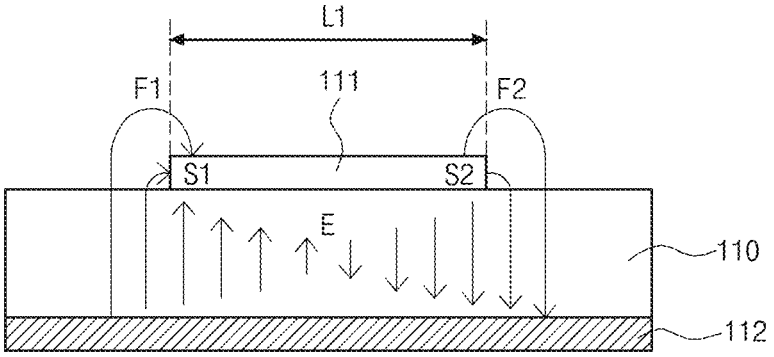
FIG. 2 is a view showing radiation of electromagnetic waves in a flat panel antenna according to the aspect of the present disclosure.

FIG. 2 is a view showing radiation of electromagnetic waves in a flat panel antenna according to the aspect of the present disclosure.

The antenna operates by radiating electromagnetic waves or responding to electromagnetic waves transmitted in free space according to a resonance phenomenon. The resonance phenomenon occurs when a natural frequency of the antenna and a frequency of an electromagnetic wave match each other. The natural frequency of the antenna may be referred to as a resonance frequency, and the resonance may vary depending on the structure of the antenna.

In the flat panel antenna according to the aspect of the present disclosure, both ends of the radiation patch 111 may be terminated with an open circuit to operate as a resonator.

Specifically, the feed line 141 of FIG. 1A and FIG. 1B may form an electric field according to a voltage applied from the outside, and the electric field formed by the feed line 141 of FIG. 1A and FIG. 1B may pass through the slot 113 of FIG. 1A and FIG. 1B and reach the radiation patch 111, so that currents can be induced to flow in the radiation patch 111.

In addition, an electric field E may be generated between the radiation patch 111 in which the current are induced and the ground plane 112.

At both ends S1 and S2, fringe fields F1 and F2 formed between the radiation patch 111 and the ground plane 112 may be exposed over the radiation patch 111. By the fringe fields F1 and F2 exposed over the radiation patch 111, the antenna can radiate an electromagnetic field having the resonance frequency.

The flat panel antenna has a length L1 corresponding to the resonance frequency. The length L1 of the flat panel antenna may be half of a guided wavelength λd in the first substrate 110 corresponding to the resonance frequency.

As shown in FIG. 2, since the fringe fields F1 and F2, which may be formed at both ends S1 and S2 of the radiation patch 111, increases an effective length of the radiation patch 111, the length L1 of the radiation patch 111 may be shorter than half of the guided wavelength λd in the first substrate 110.

Equation 1 shows an approximate value of the length L1 of the radiation patch 111, and the length L1 may be 0.49 times of the guided wavelength λd in the first substrate 110. The guided wavelength in a specific dielectric is obtained by dividing a wavelength in free space by the square root of the dielectric constant of the dielectric. Thus, the approximate value of the length L1 of the radiation patch 111 may be 0.49 times of a value obtained by dividing the wavelength λ in the free space corresponding to the resonance frequency by the square root of the dielectric constant ε1 of the first substrate 110.

$$L=0.49\lambda d=0.49\lambda/\sqrt{\varepsilon 1} \quad \text{[Equation 1]}$$

Accordingly, since a distance between both ends S1 and S2 of the radiation patch 111 approximates a half wavelength, the phase difference between the fringe fields F1 and F2 that can be formed at the both ends S1 and S2 of the radiation patch 111 may be about 180 degrees and the magnitudes of the fringe fields F1 and F2 may be the same.

Figure 3:
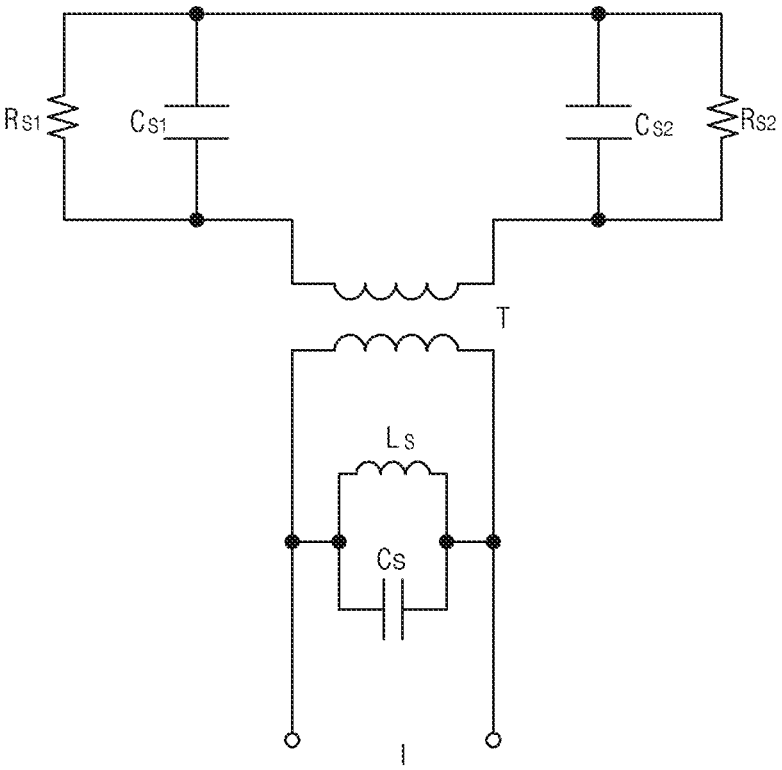
FIG. 3 is a view showing an equivalent circuit of a flat panel antenna according to the aspect of the present disclosure.

FIG. 3 is a view showing an equivalent circuit of a flat panel antenna according to the aspect of the present disclosure.

Both ends of the radiation patch 111 of FIGS. 1A, 1B and 2 may be RC circuits including resistors Rs1 and Rs2 and capacitors Cs1 and Cs2 connected in parallel, respectively. Namely, a first end of the radiation patch is an RC circuit including the resistor Rs1 and the capacitor Cs1 connected in parallel, and a second end of the radiation patch is an RC circuit including the resistor Rs2 and the capacitor Cs2 connected in parallel.

The slot 113 of FIGS. 1A and 1B may be an impedance transformer T and an LC circuit. The LC circuit may be a parallel LC circuit in which an inductor Ls and a capacitor Cs are connected in parallel.

The inductor Ls and the capacitor Cs of the LC circuit and the impedance transformer T may be connected to an input terminal I corresponding to the feed line 141 of FIGS. 1A and 1B.

When a voltage is applied to the input terminal I, the LC circuit resonates according to a first resonance frequency f1, the frequency is changed through the impedance transformer T, and a voltage resonating according to a second resonance frequency f2 is transmitted to the RC circuit.

At this time, the capacitors Cs1 and Cs2 of the RC circuit form the fringe fields F1 and F2 of FIG. 2, so that the electromagnetic waves can be radiated at the both ends of the radiation patch 111 of FIGS. 1A, 1B and 2.

With this principle, the flat panel antenna according to the aspect of the present disclosure can radiate the electromagnetic waves. In addition, by using the first substrate 110 of FIGS. 1A and 1B and the second substrate 120 of FIGS. 1A and 1B, the antenna gain G and the bandwidth BW can be increased, and the coupling loss L can be decreased. This will be described hereinafter.

Figures 4A, 4B:
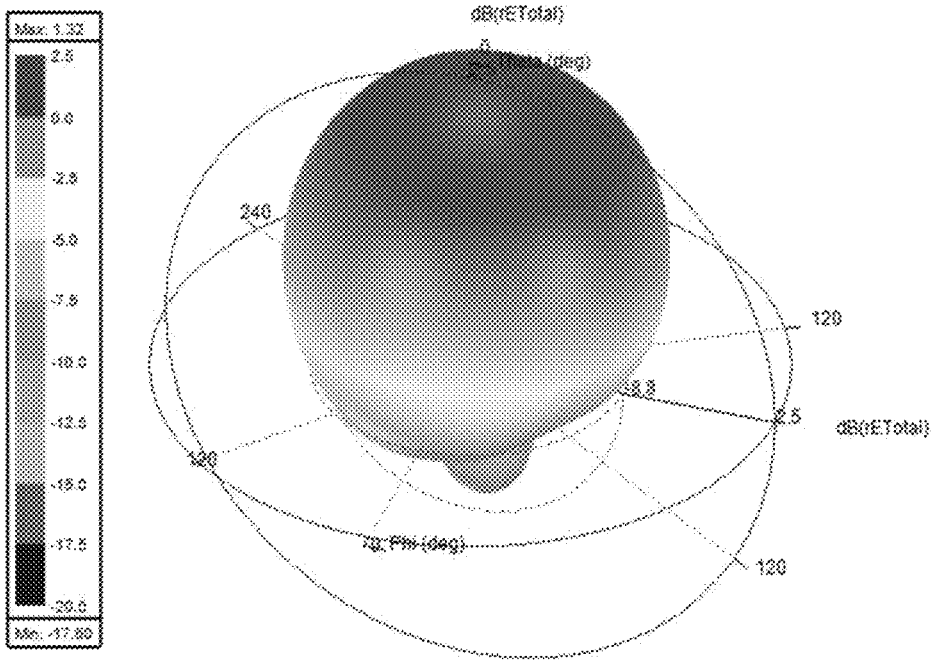
FIG. 4A is a table showing antenna gain and a bandwidth corresponding to a thickness of a first substrate in a flat panel antenna according to the aspect of the present disclosure.
FIG. 4B is a view showing a radiation pattern when the thickness of the first substrate is 0.2 mm in the flat panel antenna according to the aspect of the present disclosure.

FIG. 4A is a table showing antenna gain and a bandwidth corresponding to a thickness of a first substrate in a flat panel antenna according to the aspect of the present disclosure.

The first substrate 110 of FIG. 1A and FIG. 1B included in the flat panel antenna according to the aspect of the present disclosure may be a dielectric.

As a thickness of the dielectric increases, a wavelength of an electromagnetic wave emitted from the antenna increases, so that the resonance frequency may decrease.

In addition, as the thickness of the dielectric increases, the magnitude of a leaked electric field may increase, and thus a quality factor, i.e., Q factor at resonance may decrease.

Since the bandwidth BW increases as the Q factor decreases, an electromagnetic wave in a wide band can be emitted as the thickness of the first substrate 110 of FIG. 1A and FIG. 1B, which is a dielectric, increases.

In FIG. 4A, the bandwidth BW is shown according to the first thickness H1 of the first substrate 110 of FIG. 1A and FIG. 1B from 0.2 mm to 0.7 mm in 0.1 mm increments. It can be seen that the bandwidth BW increases from 640 MHz to 760 MHz as the first thickness H1 increases. In addition, it can be seen that the resonance frequency f decreases from 11.62 GHz to 10.68 GHz as the first thickness H1 increases.

Particularly, since the bandwidth BW is maximized to 780 MHz when the first thickness H1 is 0.5 mm, the first thickness H1 of the first substrate 110 of FIG. 1A and FIG. 1B, alternatively, may be 0.5 mm in order to use the antenna in a wide band.

The radiated power may increase as the thickness of the dielectric increases and the magnitude of the leaked electric field increases, and the antenna gain G may increase as the radiated power increases. Accordingly, the antenna gain G may increase as the thickness of the first substrate 110 of FIG. 1A and FIG. 1B, which is a dielectric, increases.

In FIG. 4A, the antenna gain G is shown according to the first thickness H1 of the first substrate 110 of FIG. 1A and FIG. 1B from 0.2 mm to 0.7 mm in 0.1 mm increments. It can be seen that the antenna gain G increases from 1.98 dBi to 3.03 dBi as the first thickness H1 increases.

Particularly, since the antenna gain G is maximized to 3.35 dBi when the first thickness H1 is 0.5 mm, the first thickness H1 of the first substrate 110 of FIG. 1A and FIG. 1B, alternatively, may be 0.5 mm in order to increase the radiation efficiency of the antenna.

Figures 4C, 5A:
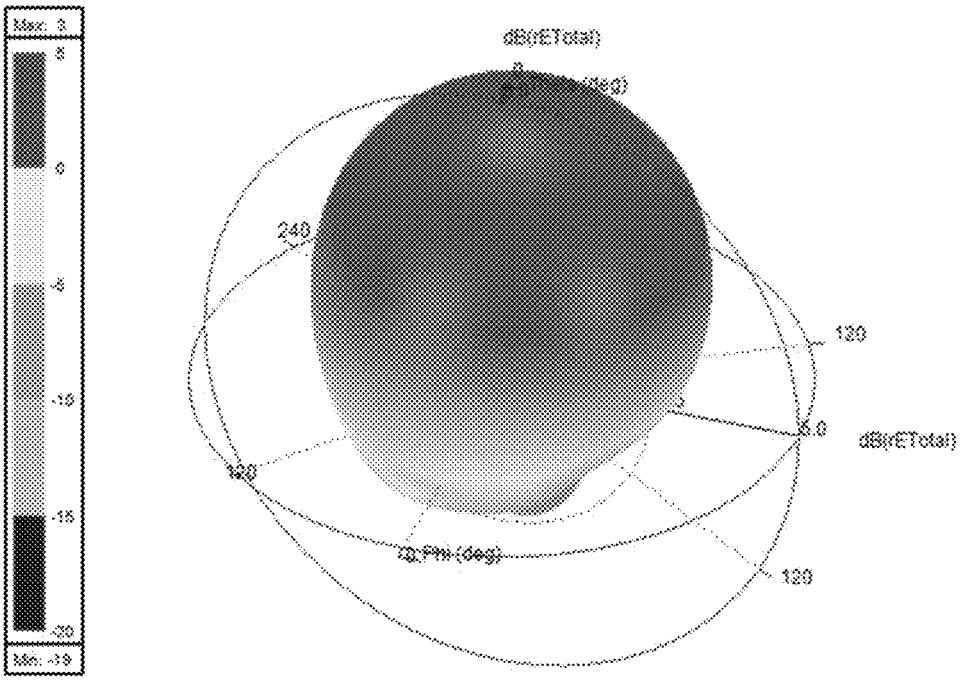
FIG. 4C is a view showing a radiation pattern when the thickness of the first substrate is 0.5 mm.
FIG. 5A is a table showing coupling loss corresponding to a thickness of a second substrate in a flat panel antenna according to the aspect of the present disclosure.

FIG. 4B is a view showing a radiation pattern when the thickness of the first substrate is 0.2 mm in the flat panel antenna according to the aspect of the present disclosure, and FIG. 4C is a view showing a radiation pattern when the thickness of the first substrate is 0.5 mm.

In FIG. 4B when the first thickness H1 of the first substrate 110 of FIG. 1A and FIG. 1B is 0.2 mm, the color of the radiation pattern on the horizontal line is close to yellow, and the antenna gain G is from −5.0 dB to −2.5 dB.

On the other hand, in FIG. 4C when the first thickness H1 of the first substrate 110 of FIG. 1A and FIG. 1B is 0.5 mm, the color of the radiation pattern on the horizontal line is close to orange, and the antenna gain G is from −2.5 dB to 0 dB. It can be seen that the antenna gain G at 0.5 mm of the first thickness H1 increases as compared with the case where the first thickness H1 is 0.2 mm.

As described above, in the flat panel antenna according to the aspect of the present disclosure, the bandwidth BW and the antenna gain G can be maximized when the first thickness H1 of the first substrate 110 of FIG. 1A and FIG. 1B increases, alternatively, at 0.5 mm.

FIG. 5A is a table showing coupling loss corresponding to a thickness of a second substrate in a flat panel antenna according to the aspect of the present disclosure.

The feed line 141 of FIG. 1A and FIG. 1B attached to a lower surface of the second substrate 120 of FIG. 1A and FIG. 1B forms an electric field according to a voltage applied from the outside, and the electric field passes through the slot 113 of FIG. 1A and FIG. 1B and reaches the radiation patch 111 of FIG. 1A and FIG. 1B, so that currents can be induced to flow in the radiation patch 111 of FIG. 1A and FIG. 1B.

As a distance between the feed line 141 of FIG. 1A and FIG. 1B and the radiation patch 111 of FIG. 1A and FIG. 1B increases, the magnitude of the electric field reaching and affecting the radiation patch 111 of FIG. 1A and FIG. 1B decreases, so that the coupling loss L may increase.

Therefore, the coupling loss L may increase as the thickness of the second substrate 120 of FIG. 1A and FIG. 1B, which may be disposed between the feed line 141 of FIG. 1A and FIG. 1B and the radiation patch 111 of FIG. 1A and FIG. 1B, increases.

In FIG. 5A, the coupling loss L is shown according to the second thickness H2 of the second substrate 120 of FIG. 1A and FIG. 1B from 0.1 mm to 0.5 mm in 0.1 mm increments at the resonance frequencies of 11 GHz, 11.5 GHz and 12 GHz. When comparing the average resonance frequency, it can be seen that the average coupling loss L increases as the second thickness H2 increases and the average coupling loss L decreases from −5.56 dB to −1.77 dB as the second thickness H2 decreases.

Particularly, since the average coupling loss L is minimized to −1.32 dB when the second thickness H2 is 0.2 mm, the second thickness H2 of the second substrate 120 of FIG. 1A and FIG. 1B, alternatively, may be 0.2 mm in order to increase the transfer efficiency when feeding from the feed line 141 of FIG. 1A and FIG. 1B to the radiation patch 111 of FIG. 1A and FIG. 1B.

FIG. 5B is a table showing the coupling loss when the thickness of the second substrate is formed to correspond to a multiple of the wavelength of the radiated electromagnetic wave in the flat panel antenna according to the aspect of the present disclosure.

In the table of FIG. 5B, the second thickness H2 of the second substrate is divided into four bands and the coupling loss L is shown corresponding thereto.

When the wavelength λ of the radiated electromagnetic wave is 27300 μm, the coupling loss L is −1.5705 dB in the case that the second thickness H2 of the second substrate 120 of FIG. 1A and FIG. 1B is between 0.018 times and 0.026 times the wavelength λ. On the other hand, in the case that the band of the second thickness H2 is lowered and is between 0.007 times and 0.015 times the wavelength λ, the coupling loss L is minimized to −1.0624 dB.

However, it can be seen that the coupling loss L increases to −1.6247 dB when the second thickness H2 is less than 0.007 times the wavelength λ.

When the wavelength λ of the radiated electromagnetic wave is 26100 μm, the coupling loss L is −1.8157 dB in the case that the second thickness H2 of the second substrate 120 of FIG. 1A and FIG. 1B is between 0.019 times and 0.027 times the wavelength λ. On the other hand, in the case that the band of the second thickness H2 is lowered and is between 0.008 times and 0.015 times the wavelength λ, the coupling loss L is minimized to −0.6959 dB.

However, it can be seen that the coupling loss L increases to −0.8299 dB when the second thickness H2 is less than 0.008 times the wavelength λ.

When the wavelength λ of the radiated electromagnetic wave is 25000 μm, the coupling loss L is −13.3117 dB in the case that the second thickness H2 of the second substrate 120 of FIG. 1A and FIG. 1B is between 0.020 times and 0.028 times the wavelength λ. On the other hand, in the case that the band of the second thickness H2 is lowered and is between 0.008 times and 0.016 times the wavelength λ, the coupling loss L is minimized to −0.6987 dB.

However, it can be seen that the coupling loss L increases to −0.9106 dB when the second thickness H2 is less than 0.008 times the wavelength λ.

In FIG. 5B, it can be seen that the coupling loss L increases when the band of the second thickness H2 of the second substrate is highest (0.018λ~0.026λ, 0.019λ~0.027λ, 0.020λ~0.028λ) and is lowest (~0.007λ, ~0.008λ) and the coupling loss L decreases in the bands therebetween.

This is because if the second thickness H2 of the second substrate 120 of FIG. 1A and FIG. 1B increases, the distance between the feed line 141 of FIG. 1A and FIG. 1B and the radiation patch 111 of FIG. 1A and FIG. 1B may increase, and the magnitude of the electric field reaching and affecting the radiation patch 111 of FIG. 1A and FIG. 1B may decrease. In addition, this is because if the second thickness H2 of the second substrate 120 of FIG. 1A and FIG. 1B is smaller than a certain range, the electric field formed from the feed line 141 of FIG. 1A and FIG. 1B and reaching the radiation patch 111 of FIG. 1A and FIG. 1B may be affected by the ground plane 112 of FIG. 1A and FIG. 1B, and the coupling loss L may increase.

Accordingly, the coupling loss L can be minimized when the second thickness H2 of the second substrate 120 of FIG. 1A and FIG. 1B is between 0.008 times, which is the maximum value when the band is lowest in FIG. 5B, and 0.018 times, which is the minimum value when the band is highest in FIG. 5B.

As described above, in the aspect of the present disclosure, the overall thickness of the antenna may be kept constant by increasing the first thickness H1 of the first substrate 110 of FIG. 1A and FIG. 1B or decreasing the second thickness H2 of the second substrate 120 of FIG. 1A and FIG. 1B. In this case, the antenna may be formed in an asymmetrical shape where the thickness of the first substrate 110 of FIG. 1A and FIG. 1B is greater than the thickness of the second substrate 120 of FIG. 1A and FIG. 1B.

FIG. 6 is a table showing crosstalk corresponding to a distance between a feed line and a part of a feed portion in a flat panel antenna according to the aspect of the present disclosure.

The feed line 141 of FIG. 1A and FIG. 1B and the radiation patch 111 of FIG. 1A and FIG. 1B may not be connected and form independent lines and may be coupled by mutually transmitting energy.

However, the feed line 141 of FIG. 1A and FIG. 1B may not be coupled with the radiation patch 111 of FIG. 1A and FIG. 1B and may be coupled with other components to thereby generate crosstalk. The crosstalk causes a decrease in efficiency of the antenna.

In the flat panel antenna according to the aspect of the present disclosure, the first spacing part ap1 of FIG. 1A and FIG. 1B and the second spacing part ap2 of FIG. 1A and FIG. 1B may be included and the feed line 141 of FIG. 1A and FIG. 1B may be spaced apart from other parts having a conductive property, so that the crosstalk can be reduced.

In FIG. 6, the crosstalk is shown for each resonance frequency of 11 GHz, 11.5 GHz and 12 GHz. It can be seen that when the resonance frequency is 11 GHz, the crosstalk is −1.0624 dB or −1.0684 dB in the case that the second width W2 of the first spacing part ap1 of FIG. 1A and FIG. 1B and the second spacing part ap2 of FIG. 1A and FIG. 1B is greater than or equal to twice the first width W1 of the feed line 141 of FIG. 1A and FIG. 1B, and the crosstalk is −1.0749 dB in the case that the second width W2 is less than twice the first width W1. Namely, the crosstalk increases in the case that the second width W2 is less than twice the first width W1. These characteristics are the same when the resonance frequencies are 11.5 GHz and 12 GHz.

Accordingly, in order to minimize the crosstalk, the second width W2 of the first spacing part ap1 of FIG. 1A and FIG. 1B and the second spacing part ap2 of FIG. 1A and FIG. 1B can be twice or more of the first width W1 of the feed line 141 of FIG. 1A and FIG. 1B.

As described above, in the flat panel antenna of the present disclosure, the radiation patch and the ground plane having the slot are provided on the first substrate, the second substrate includes the feed line, and the first substrate and the second substrate have different thicknesses, so that the antenna gain and the bandwidth can be improved and the coupling loss can be reduced.

In addition, the crosstalk can be reduced by forming the distance between the feed line and the part of the feed portion twice or more of the width of the feed line.

It will be apparent to those skilled in the art that various modifications and variations may be made in the antenna of the present disclosure without departing from the technical idea or scope of the disclosure. Thus, it is intended that the present disclosure cover the modifications and variations of this disclosure provided they come within the scope of the appended claims and their equivalents.

What is claimed is:

1. A flat panel antenna, comprising:

a first substrate on which a radiation patch and a ground plane are provided;

a second substrate;

a liquid crystal layer between the first substrate and the second substrate; and a feed portion adjacent to the second substrate, wherein the ground plane includes a slot, wherein the feed portion includes a first spacing part, a second spacing part and a feed line between the first spacing part and the second spacing part, wherein a thickness of the first substrate is greater than a thickness of the second substrate, wherein the second substrate is disposed between the liquid crystal layer and the feed portion, and wherein the liquid crystal layer includes liquid crystal molecules, and an arrangement of the liquid crystal molecules is changed according to a voltage applied to the ground plane and the feed line, thereby changing a dielectric constant of the liquid crystal layer.

2. The flat panel antenna of claim 1, wherein the first substrate and the second substrate are formed of glass and have a same dielectric constant.

3. The flat panel antenna of claim 1, wherein the thickness of the first substrate is 0.5 mm.

4. The flat panel antenna of claim 3, wherein the thickness of the second substrate is 0.2 mm.

5. The flat panel antenna of claim 1, wherein the thickness of the second substrate is 0.008 times to 0.018 times a wavelength corresponding to a resonance frequency of the antenna.

6. The flat panel antenna of claim 1, wherein the first substrate includes glass and the second substrate includes polyimide.

7. The flat panel antenna of claim 1, wherein the slot is formed in a first direction, and wherein the feed line, the first spacing part and the second spacing part are arranged in a second direction crossing the first direction.

8. The flat panel antenna of claim 1, wherein a width of the first spacing part and the second spacing part is twice or more of a width of the feed line.

9. The flat panel antenna of claim 1, wherein the feed portion includes a first portion extending in a first direction and second and third portions extending from both ends of the first portion in a second direction crossing the first direction, and wherein the first, second, and third portions and the feed line form a three-teeth comb shape.

10. The flat panel antenna of claim 1, wherein the first and second substrates have a length along a first direction perpendicular to the feed line longer than a length along a second direction parallel to the feed line.

11. The flat panel antenna of claim 1, wherein each of the first and second substrates is a single substrate.

12. A flat panel antenna, comprising:

first and second substrates facing each other and having different thicknesses;

a radiation patch disposed on a first side of the first substrate;

a ground plane provided on a second side of the first substrate and having a slot extended to a first direction;

a liquid crystal layer between the first and second substrates;

a feed portion attached to the second substrate and including a first spacing part, a second spacing part and a feed line located between the first spacing part and the second spacing part, wherein the feed line and the radiation patch are electrically coupled with a voltage supplied to the feed line and transferred to the radiation patch, wherein the second substrate is disposed between the liquid crystal layer and the feed portion, and wherein the liquid crystal layer includes liquid crystal molecules, and an arrangement of the liquid crystal molecules is changed according to a voltage applied to the ground plane and the feed line, thereby changing a dielectric constant of the liquid crystal layer.

13. The flat panel antenna of claim 12, wherein the first substrate and the second substrate have a same dielectric constant.

14. The flat panel antenna of claim 12, wherein the first substrate has a thickness greater than a thickness of the second substrate.

15. The flat panel antenna of claim 14, wherein the thickness of the first substrate is 0.5 mm.

16. The flat panel antenna of claim 14, wherein the thickness of the second substrate is 0.2 mm.

17. The flat panel antenna of claim 12, wherein the thickness of the second substrate is 0.008 times to 0.018 times a wavelength corresponding to a resonance frequency of the antenna.

18. The flat panel antenna of claim 12, wherein the first substrate includes glass and the second substrate includes polyimide.

19. The flat panel antenna of claim 12, wherein the feed line, the first spacing part and the second spacing part are arranged in a second direction perpendicular to the first direction.

20. The flat panel antenna of claim 12, wherein the radiation patch is extended to the first direction.

21. The flat panel antenna of claim 12, wherein a width of the first spacing part and the second spacing part is twice or more of a width of the feed line.

22. The flat panel antenna of claim 12, wherein the feed portion includes a first portion extending in a first direction and second and third portions extending from both ends of the first portion in a second direction crossing the first direction, and wherein the first, second, and third portions and the feed line form a three-teeth comb shape.

* * * * *